US011065178B2

(12) United States Patent
Trevino, Jr.

(10) Patent No.: US 11,065,178 B2
(45) Date of Patent: Jul. 20, 2021

(54) SPINAL MASSAGE DEVICE

(71) Applicant: Pete Trevino, Jr., Dickinson, TX (US)

(72) Inventor: Pete Trevino, Jr., Dickinson, TX (US)

( * ) Notice: Subject to any disclaimer, the term of this patent is extended or adjusted under 35 U.S.C. 154(b) by 205 days.

(21) Appl. No.: 16/152,060

(22) Filed: Oct. 4, 2018

(65) Prior Publication Data

US 2020/0107988 A1 Apr. 9, 2020

(51) Int. Cl.
*A61H 23/02* (2006.01)

(52) U.S. Cl.
CPC ..... *A61H 23/02* (2013.01); *A61H 2201/0119* (2013.01); *A61H 2201/0153* (2013.01); *A61H 2201/0157* (2013.01); *A61H 2201/1626* (2013.01); *A61H 2201/1652* (2013.01); *A61H 2201/5025* (2013.01)

(58) Field of Classification Search
CPC ..... A61H 23/02; A61H 2201/0153; A61H 2201/5025; A61H 2201/1626; A61H 2201/1652; A61H 2201/0157; A61H 1/00; A61H 1/006–008; A61H 1/0292–0296; A61H 7/00–001; A61H 7/007; A61H 23/00; A61H 39/00; A61H 39/02–04; A61H 2201/0123–1026; A61H 2201/1623; A61H 2201/165; A61H 2205/081
See application file for complete search history.

(56) References Cited

U.S. PATENT DOCUMENTS 3,279,463 A * 10/1966 Krimmel ..... A61H 7/002 601/136
3,616,794 A * 11/1971 Gromala ..... A61H 15/0092 601/120
5,374,238 A * 12/1994 Xiao ..... A61H 23/0218 601/46
5,836,900 A * 11/1998 Leventhal ..... A61H 23/02 601/57
7,087,004 B1 * 8/2006 Berke ..... A61H 7/002 482/132
2003/0028134 A1 * 2/2003 Lev ..... A61H 7/001 601/110
2004/0249323 A1 * 12/2004 Louis ..... A61H 7/003 601/135
2006/0235345 A1 * 10/2006 Ivanov ..... A47K 7/024 601/138

(Continued)

*Primary Examiner* — Justine R Yu
*Assistant Examiner* — Mayisha M Khan
(74) *Attorney, Agent, or Firm* — Gregory L. Porter; Hunton Andrews Kurth LLP

(57) ABSTRACT

A vibrating back massager with guide slot and vibrating heads is described. The guide slot is designed to restrict lateral movement of the massage device when the guide slot is engaged with a supporting member. The supporting member may be the edge of an open door, a corner, a vertical pole, or other generally available structure. The device includes a strap handle which may be draped over the user's shoulder and used to control the vertical position of the device. The described vibrating massage device allows a single user to create and maintain a significant amount of massage pressure without fatiguing his arms or relying on a second person. In a preferred embodiment, the controls for the vibrating massage device are incorporated into the strap handle so that the speed, intensity, and/or temperature may be controlled by the user without repositioning the device.

6 Claims, 6 Drawing Sheets

(56) References Cited

U.S. PATENT DOCUMENTS

| | | | | |
|---|---|---|---|---|
| 2007/0167885 | A1* | 7/2007 | Moon | A61H 11/00 601/71 |
| 2008/0077062 | A1* | 3/2008 | Leiter | A61H 7/00 601/134 |
| 2010/0010403 | A1* | 1/2010 | Haviland | A61H 7/004 601/136 |
| 2011/0071446 | A1* | 3/2011 | Citrin | A61H 39/04 601/135 |
| 2011/0166481 | A1* | 7/2011 | Rhoad | A61H 7/002 601/1 |
| 2011/0313448 | A1* | 12/2011 | Wong | A61H 39/04 606/204 |
| 2014/0221886 | A1* | 8/2014 | Chen | A61H 23/006 601/108 |
| 2015/0272814 | A1* | 10/2015 | Chen | A61H 15/0085 601/97 |
| 2015/0342815 | A1* | 12/2015 | Watson | A61H 7/007 601/136 |

* cited by examiner

SPINAL MASSAGE DEVICE

FIELD OF THE INVENTION

The present invention relates generally to a portable device for massage of the back, in particular vibrating massage of the spine, nerves, and surrounding tissues.

BACKGROUND AND SUMMARY

Conventional personal vibrating massage devices include a massaging tool at one end and a handle designed for reaching overhead to apply the massaging tool to the muscles of the user's back. The nature of conventional massage device handles require the user to reach far overhead, in an awkward and potentially painful maneuver in order to apply massaging pressure to his own back. This movement can cause pain and/or damage to the user's shoulder. In some cases, the user may not be physically able to perform this movement due to lack of flexibility or mobility. Conventional massage devices make it difficult to provide a significant degree of massaging pressure to the tissues of the back without the assistance of a second person.

A few massaging devices attempt to correct these deficiencies using longer and/or curved handles which reduce the need for shoulder mobility and allow the user to apply pressure to his own back with less awkward arm movements, however, these devices are still limited in the amount of pressure a user can apply to his own back. The user is total massaging pressure is limited by the arm strength of the user. Additionally, in order to apply a consistent pressure to a particular location on his own back, the user will have to generate force with his own muscles in the same position for an extended period of time. In addition to limiting the amount of force available, the duration massaging pressure can be applied is also limited by the user's muscular endurance.

Some professional massaging devices include table massagers, typically used by chiropractors or medical professionals. The user typically lays on the table massager which separates and extends, thereby stretching the user and potentially allowing greater access to compressed tissues. This type of treatment is often inconvenient, requires a large medical device, and can be expensive.

Mobility, strength, and muscular endurance can all be significantly reduced by injuries, tension, or other conditions in the tissues of the back. Accordingly, the user most in need of massage therapy may be least able to utilize conventional massaging devices. Many users respond to frequent massage treatment which can make visiting a chiropractor or medical professional exceedingly expensive and time-consuming.

What is needed is a massaging device which allows the user to apply significant force over an extended period of time to his own back and/or vertebrae.

BRIEF DESCRIPTION OF THE SEVERAL VIEWS OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appended drawings. It is to be noted, however, that the appended drawings only illustrate preferred embodiments of this invention, and are therefore not to be considered limiting of its scope, for the invention may admit to other equally effective embodiments that vary only in detail. In the drawings.

DESCRIPTION OF THE PREFERRED EMBODIMENTS

Figure 1:
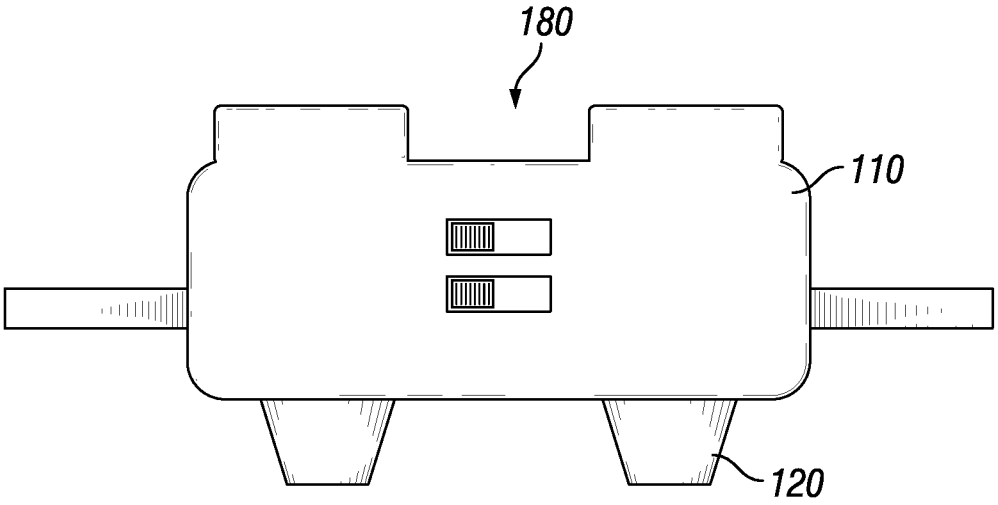
FIG. 1 is a view of a preferred embodiment of the massage device of the present invention showing massaging cones and a guide track

Certain terms are used throughout the following description and claims to refer to particular system components. As one skilled in the art will appreciate, different companies may refer to a component by different names. This document does not intend to distinguish between components that differ in name but not function.

Disclosed embodiments relate to a personal massaging device comprising a main body housing, at least one massaging head, and a guide track. A preferred embodiment comprises two vibrating massage heads which are arranged to create a gap between the two heads. This gap is designed to accommodate the bony regions of a user's vertebrae so that the vibrating massage heads contact the user on either side of the user's spine. This arrangement allows therapeutic vibration to penetrate into the tissues around the user's spine including the vertebrae, discs, ligaments, connective tissues, nerves, and muscles. Disclosed embodiments allow the user to direct therapeutic vibration massage to the desired area without the assistance of another person and to generate and maintain significant massage pressure with the user's body and legs, rather than the user's arms. In certain embodiments, massaging waves are directed to injured tissues, including but not limited to nerves, for providing relief from pain and/or discomfort. Disclosed embodiments may allow users to increase blood flow, deliver oxygen and/or nutrients to an area, break up muscular and/or connective tissue adhesions, and/or relax the muscles in a desired portion of the user's back. Preferred embodiments are light-weight and/or small enough to be portable and may be carried with the user while traveling Unlike traditional personal massage devices, disclosed embodiments, utilize a guide slot which limits the lateral and rotational movements of the device when the guide slot is aligned with an available support structure. The guide slot allows the user to align the device with any suitable support structure and lean back or recline against the massage device in order to general a significant amount of pressure between the user and the heads of the device. This arrangement also allows the user to maintain massage pressure for an extended period of time without fatiguing his arms as is commonly required by conventional personal massage devices. Maintaining a significant amount of pressure on a user's back for an extended period of time has been previously difficult or impossible for a user to do himself. By utilizing the disclosed guide slot, the user may position the device and then lean back, thereby stabilizing himself and creating pressure with the user's legs and body rather than the user's arms. Disclosed embodiments also allow the user to arch his spine forwards, backward, and/or laterally, thereby repositioning the tissues being massaged. This may allow greater accesses to the tissues being massaged due to altered positioning.

In some embodiments, the guide slot is an integrally formed portion of the main body or housing of the device. In other embodiments, the guide slot may be formed by separate pieces of material attached to the main body of the device in order to create raised areas with a guide slot depression in between. The guide slot may be any size or shape that may be used to restrict lateral and rotational motion of the device by engaging the guide slot with a stable structure.

In some embodiments, the guide slot comprises three surfaces and forms a generally rectangular slot. In other embodiments, the guide slot may have a single curved surface, two surfaces which create a triangular guide slot, or four surfaces which create a generally hexagonal guide slot.

In some embodiments, the guide slot is designed to accommodate the edge of a door. When using such embodiments with a door, users may optionally restrain the door from opening or closing in order to provide additional stability to the door but this is strictly optional. In some embodiments, the guide slot is designed to accommodate a corner such as, for example, the about 90 degree corner formed by two walls. In some embodiments, the guide slot may be designed to accommodate a pole or other rounded structure. Support structures may include any object or structure that is sufficiently sturdy to withstand the user pressing back against the structure. Exemplary support structures include, but are not limited to doors, corners, walls, book cases, door frames, poles, equipment, fencing, and/or furniture.

Some embodiments utilize flexible strap handles which allow the user to adjust the vertical position of the device while maintaining the lateral and rotational position of the device. The handles connect to a portion of the massage device and may be positioned over the user's shoulders, such that the user can comfortable hold the handles in front of his body and raise or lower the device by pulling on the handles or by allowing gravity to pull the device lower down. The user may maintain the lateral and rotational position of the device using the guide slot while adjusting the vertical position by reducing the pressure between the user and the device until the device may be moved. This may be done without disengaging the device from the support structure, thereby maintaining alignment The flexible handles may be made of any suitably flexible material including, but not limited to, rope, cord, cloth, straps, webbing, cable, wires and combinations thereof.

In some disclosed embodiments, the massage heads are generally conical although the massage heads may by any suitable size and/or shape. Some embodiments utilize rounded and/or blunted tip massage heads. In some embodiments, the massage heads are generally hemi-spherical. The massage heads may be made of any suitable material including, but not limited to rubber, silicone, polymers, metal, elastomers, and combinations thereof.

In certain embodiments, the massage heads are configured to be heated. Heating elements may be contained within the massage heads in order to provide additional therapeutic benefit to the user during use of the device.

Preferred embodiments comprise two massage heads which are configured to create a gap in between the massage heads in order to accommodate the user's spine. Some embodiments may comprise four, or six, or eight massage heads which are configured in pairs in order to create an elongated gap between the multiple pairs of massage heads.

Regardless of the number of massage heads, the gap may be through of as running in a generally parallel direction as the guide slot. In many embodiments, the center of the gap between massage heads will be generally aligned with the center of the guide slot. This allows the user to press his back evenly against both or all massage heads while keeping the guide slot securely engaged with the supporting structure.

In some embodiments, the gap may be at least 1 inch wide, or at least 2 inches wide or at least three inches wide. In some embodiments, the gap is at most 5 inches wide, or at most 4 inches wide, or at most 3 inches wide.

Controls for the disclosed massaging device may be placed anywhere on the housing that does not interfere with the operation of the device. Preferred embodiments do not include controls on the side of the housing opposite the massage heads because that may interfere with the use of the guide slot. In some embodiments, the controls are positioned on to top of the main body housing. In preferred embodiments, the controls are positioned at the distal end of a strap handle. This allows the user to control the speed, intensity, and/or temperature while the device is in use without significantly adjusting the positioning of the device. In such embodiments, the strap handle includes a control cable which communicates signals from the controls to the electronics, motors, and/or heating elements within the main body housing. In certain embodiments, the control cable may be reinforced in order to withstand the tensile loads generated by the user pulling the strap handle in order to control the vertical position of the device without damaging or stressing any electronic connections.

Preferred embodiments of the disclosed device are portable. Some embodiments may weigh at most about 10 pounds, or at most about 8 pounds, or at most about 6 pounds or at most about 4 pounds. Certain embodiments may be at most about 12 inches in any dimension, or at most about 10 inches, or at most about 8 inches, or at most about 6 inches, or at most about 4 inches in the longest dimension.

Disclosed embodiments are generally electrically powered using a power cable plugged into a wall outlet. As an appropriate support structure is not always located adjacent to an electrical outlet, preferred embodiments comprise an extended length power cord. In some embodiments, the power cord is at least about 8 feet long, or at least about 10 feet long, or at least about 12 feet long, or at least about 16 feet long, or at least about 20 feet long. Certain embodiments may be battery powered and do not require a power cord at all.

Certain embodiments may utilize additional lateral stabilizing structures called wings. In such embodiments, the wings extend laterally from the main body housing and may be used to further prevent the device from rotating more than is desirable. When the device is used on narrow supporting structures, the wings may stabilize the device by contacting the back of the user, thereby preventing the device from rolling out of position.

Figure 2:
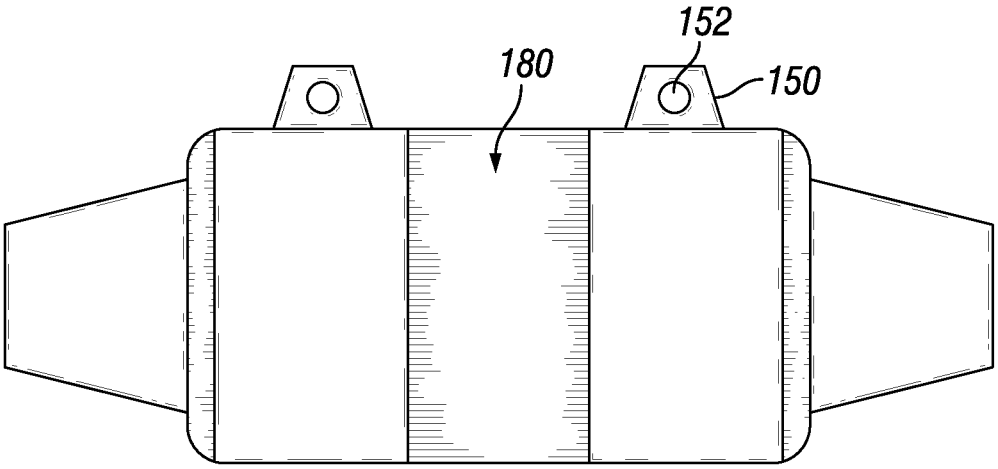
FIG. 2 is a side view of the back of a preferred embodiment of the massage device of the present invention.
Figure 3:
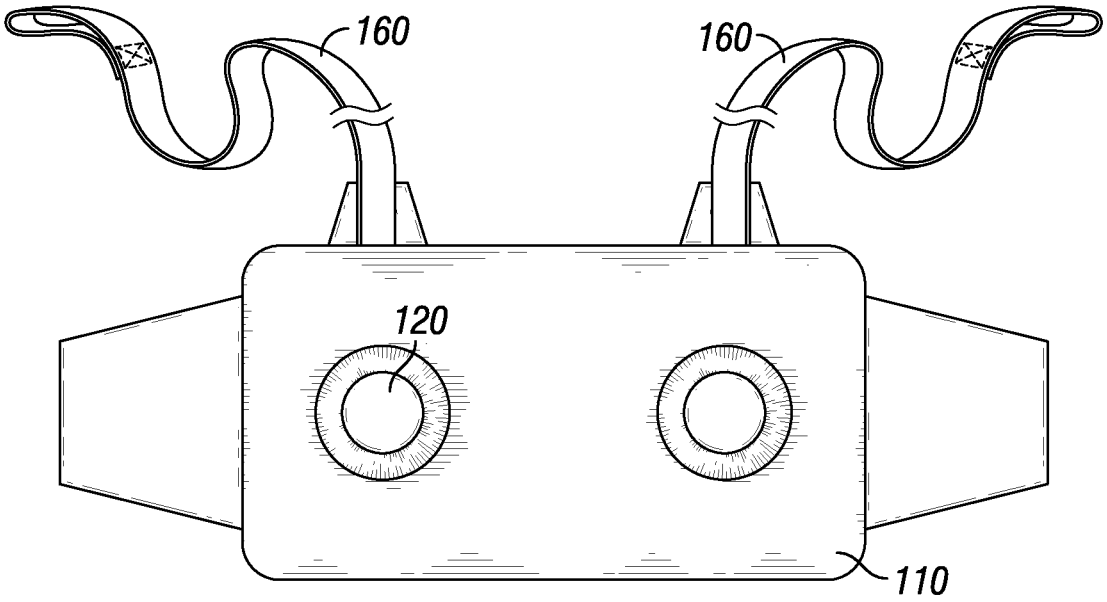
FIG. 3 is a side view of the front of a preferred embodiment of the disclosed massage device.

Referring now to FIGS. 1-2, a disclosed embodiment of the massage device comprises a main body 110 having two massage heads 120, a guide slot 180, and two handle mounting flanges 150 each with an attachment opening 152. In a preferred embodiment, guide slot 180 is formed between two sections of the main body 110. Also in a preferred embodiment, the handle mounting flanges 150 and attachment openings 152 are integrally formed portions of the main body 110. In other embodiments, mounting flanges 150 may be separate components which are attached to the main body 110. Attachment opening 152 may be used to connect strap handles 160 to the device. In some embodiments attachment opening 152 may be replaced by hooks, or the strap handles 160 may be integrally attached to the main body 110, as shown in FIG. 3. In the embodiment shown in FIG. 1, controls 170 are positioned on top of the massage device although the controls 170 may be positioned on any side that does not interfere with the operation of the device or on the handles 160.

Figure 4:
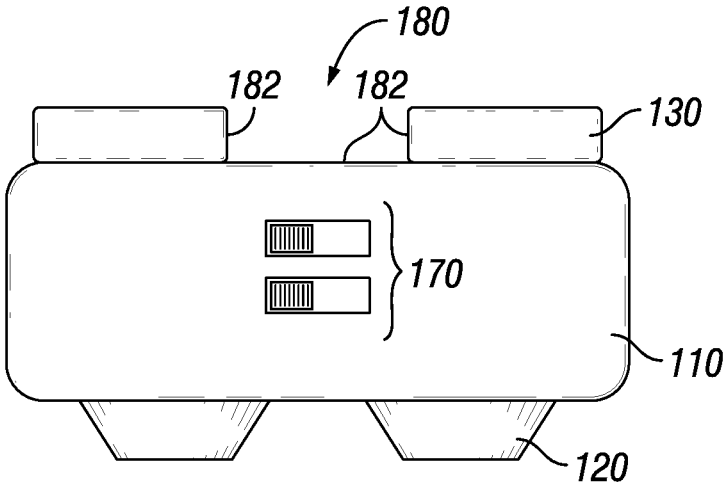
FIG. 4 shows an embodiment of the disclosed massage device with blunted massage heads and guide slot pads.
Figure 5:
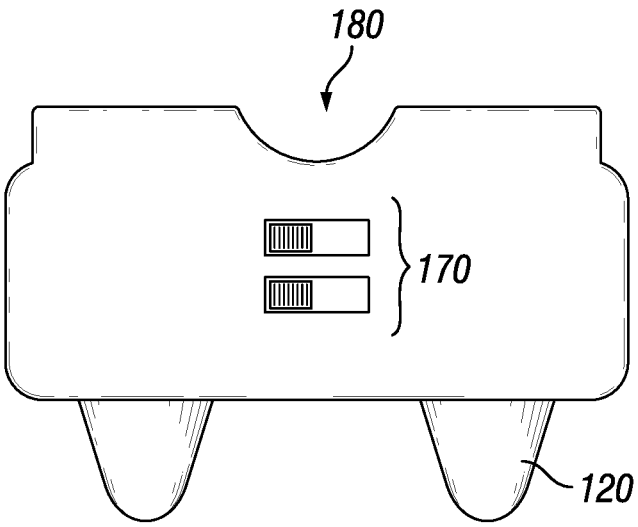
FIG. 5 shows an embodiment of the disclosed massage device with elongated massage heads and a curved guide slot.
Figure 6:
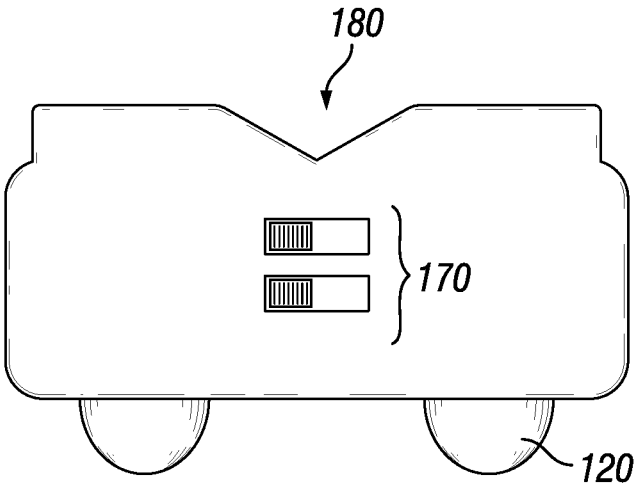
FIG. 6 shows an embodiment of the disclosed massage device with rounded massage heads and a triangular guide slot.
Figure 7:
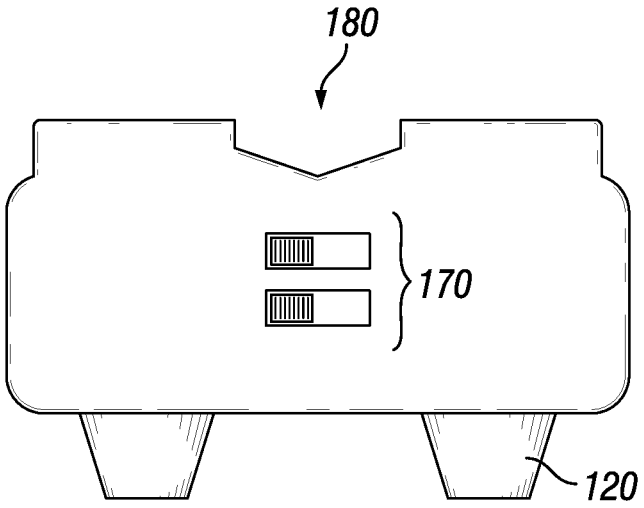
FIG. 7 shows an embodiment of the disclosed massage device with blunted massage heads and a four-sided guide slot.

Referring to FIG. 4, in some embodiments, the guide slot 180 may be formed using raised pads 130 which are adhered or otherwise attached to the main body 110. In some embodiments, the guide slot comprises three surfaces 182 and forms a generally rectangular slot. In other embodiments, as shown in FIGS. 5-7, the guide slot may have a single curved surface, two surfaces which create a triangular guide slot, or four surfaces which create a generally hexagonal guide slot.

Also as shown in FIGS. 4-7, some embodiments utilize rounded and/or blunted tip massage heads. In some embodiments, the massage heads are generally hemi-spherical. The massage heads may be made of any suitable material including, but not limited to rubber, silicone, polymers, metal, elastomers, and combinations thereof.

Figure 8:
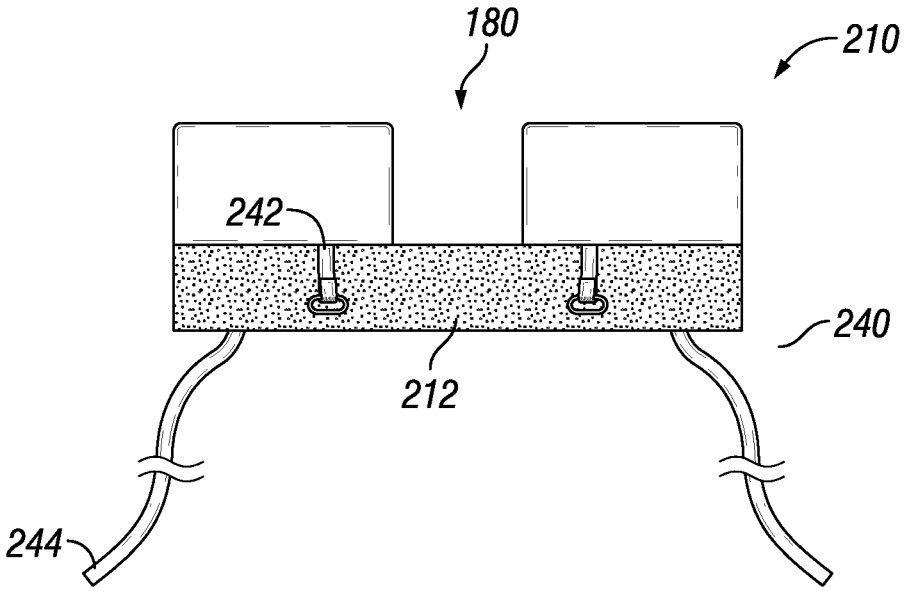
FIG. 8 shows an embodiment of a retro-fit device.
Figure 9:
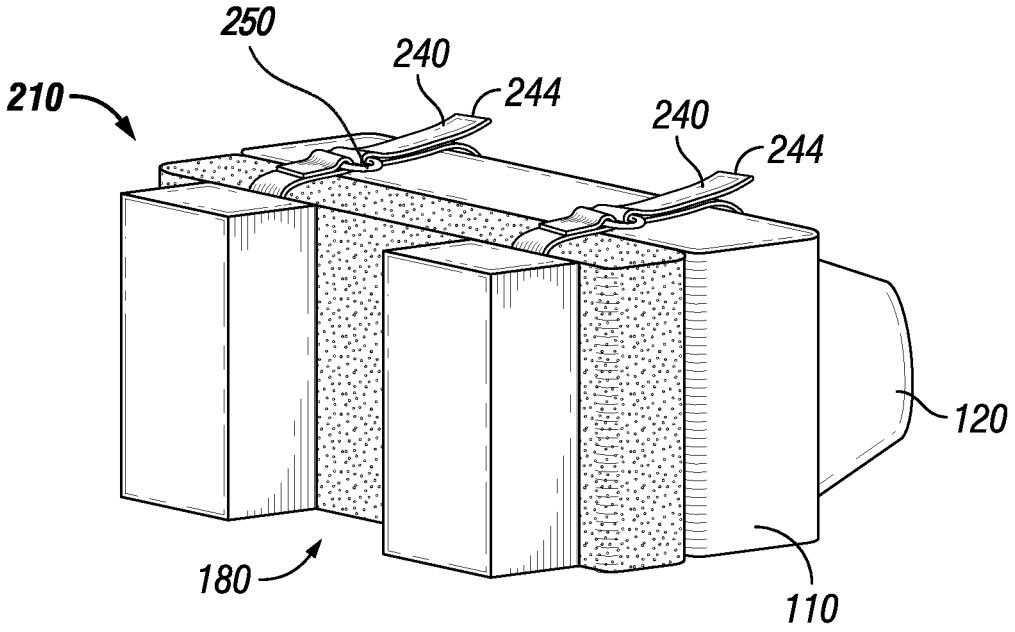
FIG. 9 shows an embodiment of a retro-fit device.

FIGS. 8 and 9 show an alternative embodiment of the disclosed invention which relates to a retrofit kit for pre-existing personal massage devices which includes a retrofit body housing 210 with a guide slot 180 and a plurality of retaining straps 240. In such an embodiment, the retaining straps 240 are used to securely attach an existing personal massager (not shown) to the retrofit housing 210 which includes a guide slot. This converts an existing personal massager into a more useful device which can be utilized by a single person to generate and maintain significant massage pressure as described above.

In some embodiments, the retrofit body 210 includes a guide slot and a deformable portion 212 designed to accommodate and/or conform to a wide range of pre-existing massage devices. The deformable portion 212 of the retrofit body may be made of any deformable material, including but not limited to, foams, padding, rubbers, polymers, or gels. Embodiments of the retrofit device include a plurality of retaining straps 240, each with a first and second end. The first end 242 of a retaining strap is attached to the retrofit body. The second end 244 of the retaining strap is configured to pass through a retaining loop 250, be pulled in order to secure the existing massage device to the retrofit body housing 210, and then be secured. In a preferred embodiment, the retaining straps 240 comprise hook and loop fasteners so that the second end of a retaining strap can be pulled through a retaining loop 250 and then fastened to the first end of the retaining strap. Some embodiments comprise at least 4 retaining straps, or at least 6 retaining straps, or at least 8 retaining straps.

Retaining loops 250 may be any loop which allows a retaining strap 240 to be passed through and then pulled tightly in order to generate a retaining force. In preferred embodiments, the retaining loops are hingedly attached to the retrofit body. In some embodiments, the retaining loops are made of a flexible material, thereby allowing the retaining loop to conform to the shape of the pre-existing massage device.

Figure 10:
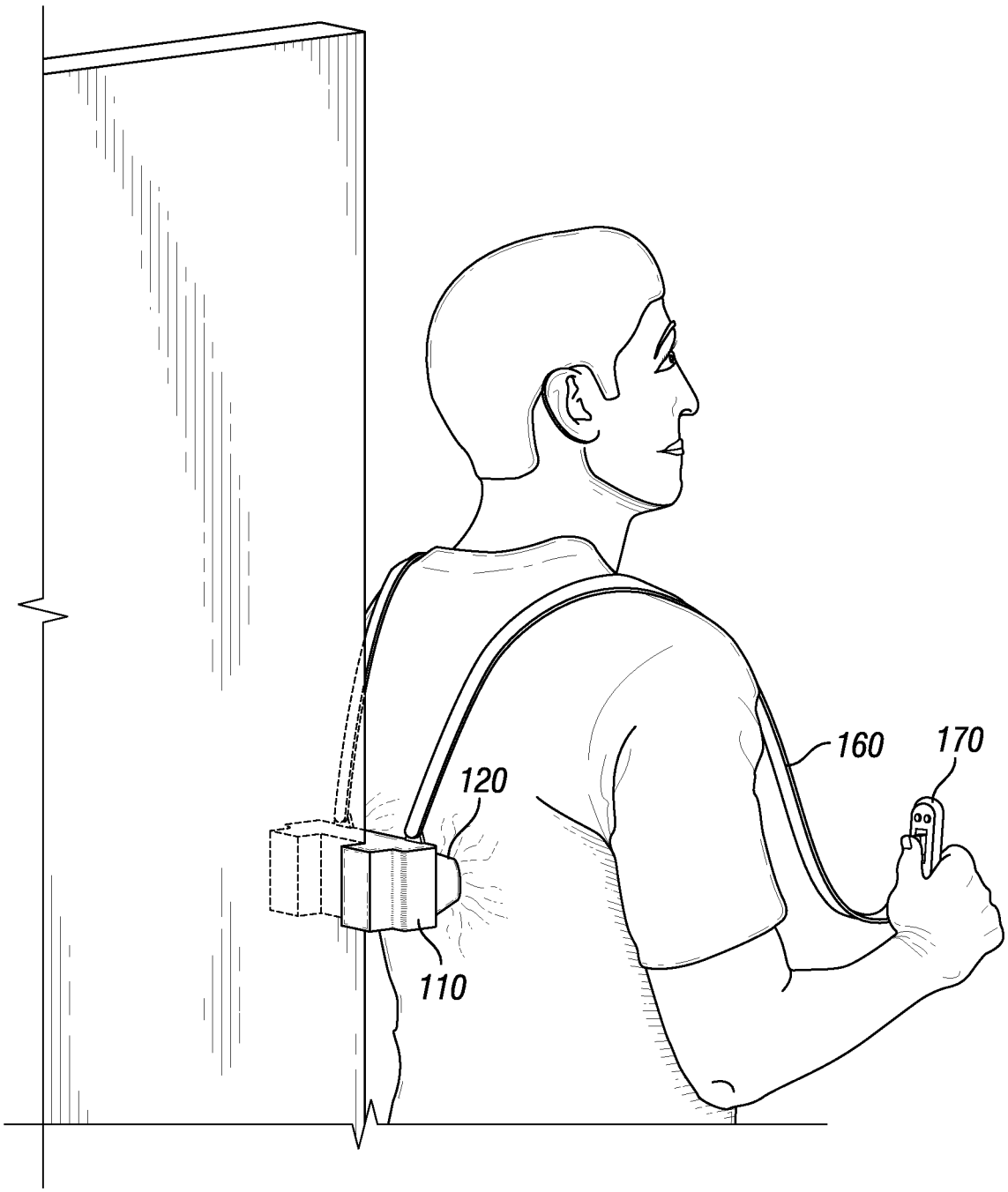
FIG. 10 shows an exemplary embodiment of the disclosed massage device in use.

FIG. 10 shows an exemplary embodiment of the disclosed massage device in use. Disclosed embodiments relate to a method of providing vibrating massage without the user generating massage pressure with his arms, the method comprising obtaining a vibrating massage device comprising a guide slot, two vibrating massage heads, and a strap handle 160; positioning the walls of the guide slot around a supporting structure such as the edge of a door or the corner of a wall in order to restrict the lateral movement of the device 110; positioning the user's spine in between two vibrating massage heads 120; leaning back in order to create a slight amount of pressure between the user's back and the massage device which is prevented from moving further backward by the supporting structure; utilizing flexible strap handles to position the massage device at the desired vertical location; and increasing the pressure between the user's back and the massage device by leaning back against the device 110; optionally moving the users feet further from the base of the supporting structure in order to increase pressure between the user's body and the massage device 110.

Disclosed embodiments allow the user to stand, sit, squat, and/or kneel while utilizing the massaging device. This also allows the user to arch his back forward, backward, and/or laterally, thereby relieving pressure on portions of the spine and/or allowing greater access to certain tissues.

The foregoing disclosure and description of the invention are illustrative and explanatory thereof, and various changes in the size, shape and materials, as well as in the details of the illustrated construction, may be made without departing from the spirit of the invention. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A personal massage retrofit device comprising: a housing with a front side and a rear side, wherein the rear side of the housing comprises a guide slot comprised of two guide slot pads configured to engage a supporting structure to restrict lateral movement of the device while allowing vertical movement of the device and the front side of the housing comprises a deformable material for receiving a portion of a personal massage device; a plurality of retaining straps wherein the plurality of retaining straps are attached to the housing and designed to retain a motorized personal massage device; and a plurality of retaining rings wherein the retaining rings are attached to the housing and wherein the retaining rings are configured to receive a strap handle that controls the vertical position of the device while engaged with a supporting structure.

2. The retrofit device of claim 1, wherein the plurality of retaining straps comprise at least one restraining strap with a first end and a second end and wherein a loop portion of a hook and loop fastener is disposed at the first end of the at least one retaining strap and a hook portion of a hook and loop fastener is disposed at the second end of the at least one retaining strap.

3. The retrofit device of claim 1, wherein the deformable material comprises a material selected from the group consisting of a foam, a padding, a rubber, a polymer, or a gel.

4. The retrofit device of claim 1, wherein the plurality of retaining straps comprises at least 4 retaining straps.

5. The retrofit device of claim 1, wherein the plurality of retaining straps comprises at least 6 retaining straps.

6. The retrofit device of claim 1, wherein the plurality of retaining straps comprises at least 8 retaining straps.

* * * * *